US011602246B2

(12) United States Patent
Shrak

(10) Patent No.: US 11,602,246 B2
(45) Date of Patent: Mar. 14, 2023

(54) BABY BATHERS WITH PHASE-CHANGE MATERIALS

(71) Applicant: Baby Patent Ltd., Ramat Gan (IL)

(72) Inventor: Oren Shrak, Tel Aviv (IL)

(73) Assignee: BABY PATENT LTD., Tel Aviv (IL)

( * ) Notice: Subject to any disclaimer, the term of this patent is extended or adjusted under 35 U.S.C. 154(b) by 17 days.

(21) Appl. No.: 17/138,993

(22) Filed: Dec. 31, 2020

(65) Prior Publication Data

US 2022/0202259 A1 Jun. 30, 2022

(51) Int. Cl.

| | |
|---|---|
| ***A47K 3/024*** | (2006.01) |
| ***A47K 3/12*** | (2006.01) |
| ***F24H 1/54*** | (2022.01) |

(52) U.S. Cl.

CPC ..... *A47K 3/024* (2013.01); *A47K 3/127* (2013.01); *F24H 1/54* (2022.01)

(58) Field of Classification Search

CPC ..... F28D 20/026; F24J 2/34; F24H 9/1818; F24H 1/54; F24H 1/181–183; B65D 81/3869–3874; A61H 33/0095; A47K 3/022–034; A47C 7/748

See application file for complete search history.

(56) References Cited

U.S. PATENT DOCUMENTS

| | | | | |
|---|---|---|---|---|
| 722,232 A | | 3/1903 | Hoeglauer | |
| 3,854,156 A | * | 12/1974 | Williams | A61F 7/03 5/93.1 |
| 4,332,214 A | * | 6/1982 | Cunningham | A01K 1/0353 119/482 |
| 4,903,352 A | | 2/1990 | Murakami | |
| 7,814,584 B2 | * | 10/2010 | Robles | A47K 3/074 4/572.1 |
| 7,999,198 B2 | | 8/2011 | Shrak et al. | |
| 8,257,417 B2 | | 9/2012 | Chen et al. | |
| 2010/0180372 A1 | * | 7/2010 | Ossi | A47K 3/02 4/545 |

(Continued)

FOREIGN PATENT DOCUMENTS

| | | | | |
|---|---|---|---|---|
| CN | 202915559 | * | 5/2013 | F24H 7/02 |
| CN | 104783706 A | | 7/2015 | |

(Continued)

OTHER PUBLICATIONS

Wikipedia, "Thermochromism," pp. 1-8, Nov. 12, 2020 downloaded from https://web.archive.org/web/20201112032308/https://en.m.wikipedia.org/wiki/Thermochromism.

(Continued)

*Primary Examiner* — David P Angwin
*Assistant Examiner* — Nicholas A Ros
(74) *Attorney, Agent, or Firm* — Kligler & Associates Patent Attorneys Ltd

(57) ABSTRACT

An apparatus includes a person-supporting structure including a first surface, configured to face a person while the person-supporting structure supports the person, and a second surface behind the first surface. The apparatus further includes a cover coupled to the second surface of the person-supporting structure and configured to contain water between the cover and the person-supporting structure such that the water transfers heat to the person-supporting structure. Other embodiments are also described.

10 Claims, 6 Drawing Sheets

(56) References Cited

U.S. PATENT DOCUMENTS

| | | | | |
|---|---|---|---|---|
| 2015/0066119 | A1* | 3/2015 | Panicker | A61F 7/0097 607/104 |
| 2015/0359389 | A1* | 12/2015 | Windenberger | A47K 3/024 4/572.1 |
| 2016/0332799 | A1 | 11/2016 | Kolowich et al. | |
| 2017/0216087 | A1 | 8/2017 | Srinivasan | |
| 2018/0092371 | A1 | 4/2018 | Collins et al. | |
| 2018/0339833 | A1 | 11/2018 | Huang et al. | |

FOREIGN PATENT DOCUMENTS

| | | | | |
|---|---|---|---|---|
| CN | 108489098 | * | 9/2018 | A47K 3/06 |
| DE | 102015012017 | A | 3/2016 | |
| KR | 200468086 | Y1 | 8/2013 | |

OTHER PUBLICATIONS

Amazon, "Thermochromic Temperature Activated Pigmet Powder," Amazon catalogue, pp. 1-9, years 1996-2021 downloaded from https://www.amazon.com/Thermochromic-Temperature-Activated-Pigment-Powder/dp/B06XPTLKG3?th=1&psc=1.

PCM, "Thermal Energy Storage", pp. 1-6, Aug. 15, 2013.

* cited by examiner

BABY BATHERS WITH PHASE-CHANGE MATERIALS

FIELD OF THE INVENTION

The present invention is related to the field of personal care, such as baby care.

BACKGROUND

US Patent Application Publication 2016/0332799 describes a liquid receptacle having an inner vessel for holding a liquid, an insulated outer shell spaced from the inner vessel, and a chamber defined between the inner vessel and the outer shell. A phase-change material is disposed in the chamber for absorbing thermal energy from the liquid and then releasing the thermal energy back to the liquid to maintain the temperature of the liquid.

SUMMARY OF THE INVENTION

There is provided, in accordance with some embodiments of the present invention, an apparatus including a person-supporting structure including a first surface, configured to face a person while the person-supporting structure supports the person, and a second surface behind the first surface. The apparatus further includes a cover coupled to the second surface of the person-supporting structure and configured to contain water between the cover and the person-supporting structure such that the water transfers heat to the person-supporting structure.

In some embodiments, the apparatus further includes a heat-transfer material disposed behind the first surface of the person-supporting structure, the cover being configured to contain the water between the cover and the heat-transfer material such that the water transfers the heat to the person-supporting structure by heating the heat-transfer material such that, subsequently to the water heating the heat-transfer material, the heat-transfer material transfers the heat to the person-supporting structure.

In some embodiments, the heat-transfer material includes a phase-change material (PCM).

In some embodiments, the heat-transfer material is contained between the first surface and the second surface of the person-supporting structure.

In some embodiments, the apparatus further includes a container containing the heat-transfer material and coupled to the second surface of the person-supporting structure, the cover being configured to contain the water between the cover and the container.

In some embodiments, the cover is coupled to the second surface of the person-supporting structure by virtue of being coupled to the container.

In some embodiments, a surface of the container is curved.

In some embodiments, the container includes an at least partly transparent portion, and the cover includes an at least partly transparent window aligned with the at least partly transparent portion of the container.

In some embodiments, the at least partly transparent portion is shaped to define a plurality of differently-sized protrusions filled with the heat-transfer material.

In some embodiments, the person-supporting structure includes a bathtub.

In some embodiments, the bathtub includes a baby bather.

In some embodiments, the person-supporting structure includes a changing table.

In some embodiments, the person-supporting structure includes a seat.

In some embodiments, the cover includes a heating element configured to heat the water such that the water transfers the heat to the person-supporting structure.

There is further provided, in accordance with some embodiments of the present invention, an apparatus including a person-supporting structure including a surface configured to face a person while the person-supporting structure supports the person. The apparatus further includes a heat-transfer material disposed behind the surface of the person-supporting structure and configured to transfer heat to the person-supporting structure, and a heating device reversibly couplable to the person-supporting structure and configured to, prior to the heat-transfer material transferring the heat to the person-supporting structure, heat the heat-transfer material while coupled to the person-supporting structure.

In some embodiments, the surface is a first surface, the person-supporting structure further includes a second surface behind the first surface, and the apparatus further includes a container containing the heat-transfer material and coupled to the second surface of the person-supporting structure.

In some embodiments, the heating device is reversibly couplable to the person-supporting structure by virtue of being reversibly couplable to the container.

In some embodiments, the container includes an at least partly transparent portion, and the first surface of the person-supporting structure includes an at least partly transparent window aligned with the at least partly transparent portion of the container.

In some embodiments, the heating device is shaped to define a water chamber configured to contain water, and the heating device is configured to heat the heat-transfer material by virtue of the water heating the heat-transfer material.

In some embodiments, the heating device further includes a heating element configured to heat the water such that the water heats the heat-transfer material.

In some embodiments, the heating device includes a heating element configured to heat the heat-transfer material.

There is further provided, in accordance with some embodiments of the present invention, an apparatus including a person-supporting structure. The apparatus further includes a container containing a heat-transfer material and being reversibly couplable to the person-supporting structure such that, while the container is coupled to the person-supporting structure, the heat-transfer material transfers heat to the person-supporting structure. The apparatus further includes a heating device reversibly couplable to the container and configured to, prior to the heat-transfer material transferring the heat to the person-supporting structure, heat the heat-transfer material while coupled to the container.

There is further provided, in accordance with some embodiments of the present invention, an apparatus including a person-supporting structure including a surface configured to face a person while the person-supporting structure supports the person. The apparatus further includes a heat-transfer material disposed behind the surface of the person-supporting structure, and a heating element coupled to the person-supporting structure and configured to heat the heat-transfer material such that, subsequently to the heating element heating the heat-transfer material, the heat-transfer material transfers heat to the person-supporting structure.

There is further provided, in accordance with some embodiments of the present invention, a method including heating a heat-transfer material while the heat-transfer material is disposed behind a surface of a person-supporting structure that is configured to face a person while the person-supporting structure supports the person. The method further includes, subsequently to heating the heat-transfer material, using the person-supporting structure while heat is transferred from the heat-transfer material to the person-supporting structure.

In some embodiments, heating the heat-transfer material includes using water to heat the heat-transfer material.

In some embodiments, heating the heat-transfer material includes using a heating element to heat the heat-transfer material.

The present invention will be more fully understood from the following detailed description of embodiments thereof, taken together with the drawings, in which:

DETAILED DESCRIPTION OF EMBODIMENTS

Overview

When bathing a baby in a baby bather, it may be challenging to keep the baby warm.

To address this challenge, embodiments of the present invention provide a container of phase-change material (PCM), which is coupled to the outer surface of the bather. Prior to bathing the baby, the PCM is heated, typically until at least some of the PCM changes phase. The baby may then be bathed in the bather while the PCM transfers heat to the bather, thus keeping the baby (along with any water in the bather) warm.

In some embodiments, the PCM container is disposed within a separate water chamber disposed beneath the bather, and the PCM is heated by water in the water chamber. For example, the user may fill the water chamber with hot water, such as water boiled in a kettle. Alternatively, the bather may additionally comprise a heating element, configured to heat water in the water chamber (e.g., to a boil) when connected to a source of electricity (e.g., a battery), such that the water subsequently transfers heat to the PCM. Advantageously, such embodiments provide an inherent safety limit to the amount of heat that may be transferred to the PCM, by virtue of the limited capacity of the water chamber and the maximum temperature of the water (typically, 100 degrees Celsius).

In other embodiments, the bather does not comprise a separate water chamber. Rather, the bather comprises a heating element configured to heat the PCM, directly, when connected to a source of electricity. In such embodiments, suitable electronic circuitry may safely limit the amount of heat transferred from the heating element to the PCM.

In yet other embodiments, a separate heating device heats the PCM. The heating device may comprise a water chamber, along with, optionally, a heating element for heating water in the water chamber. Alternatively, the heating device may comprise a heating element, without a water chamber. To heat the PCM, the bather may be coupled to the heating device such that the container is aligned with a heat-transferring surface of the heating device. Subsequently to the heating of the PCM container, the bather may be uncoupled from the heating device. Alternatively, to heat the PCM, the PCM container may be uncoupled from the bather and coupled to the heating device. Subsequently to the heating of the PCM container, the PCM container may be uncoupled from the heating device and then recoupled to the bather.

In some embodiments, a portion of the PCM container is transparent. Given that a change in phase of the PCM, such as a change from a solid phase to a liquid phase, is typically accompanied by a change in color, the user may readily ascertain, via the transparent portion of the container, when at least some of the PCM has changed phase. In other embodiments, the user simply waits an amount of time sufficient for at least some of the PCM to change phase.

Apparatus Description

Figure 1:
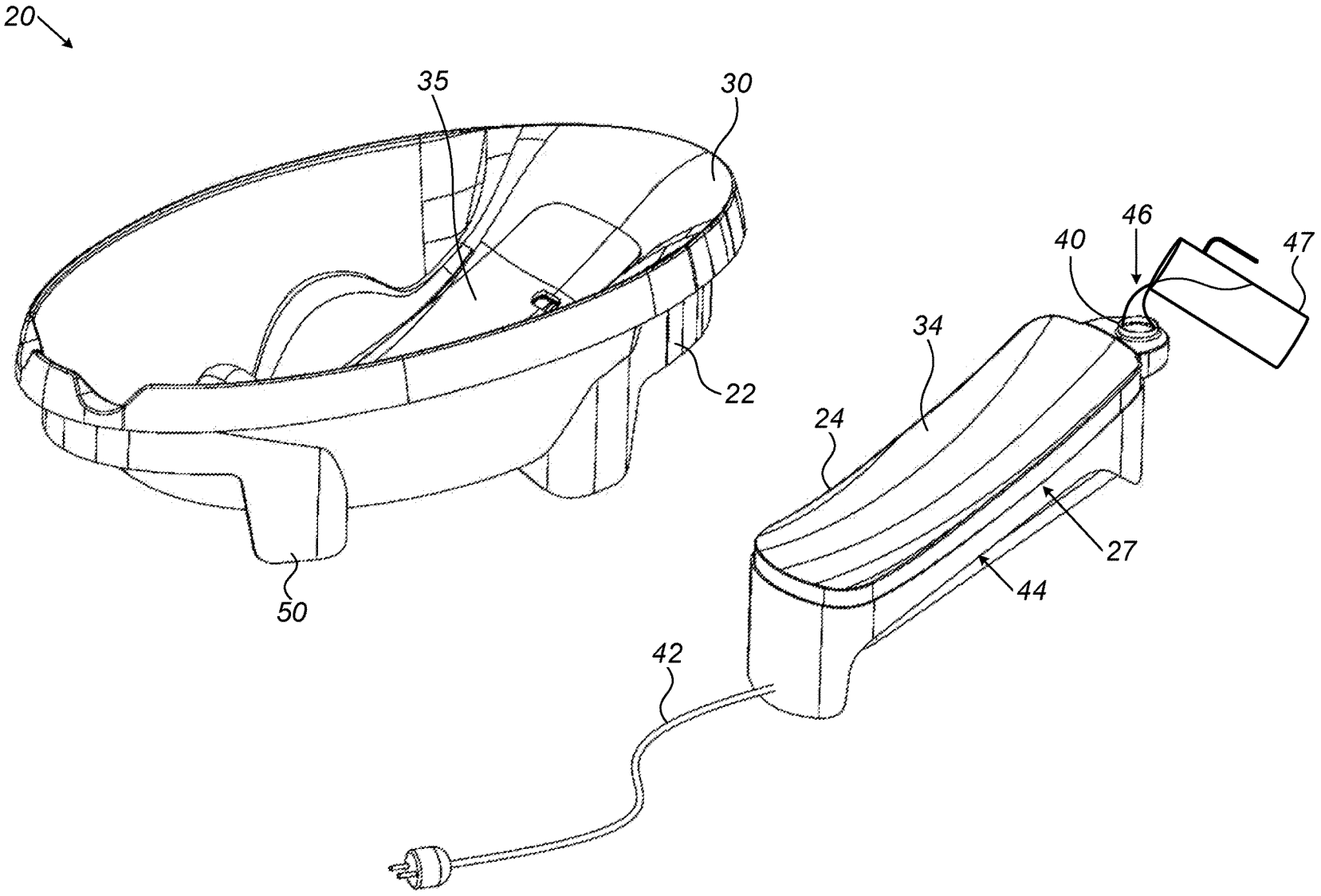
FIG. 1 is a schematic illustration of an apparatus for bathing a baby, in accordance with some embodiments of the present invention.
Figure 3B:
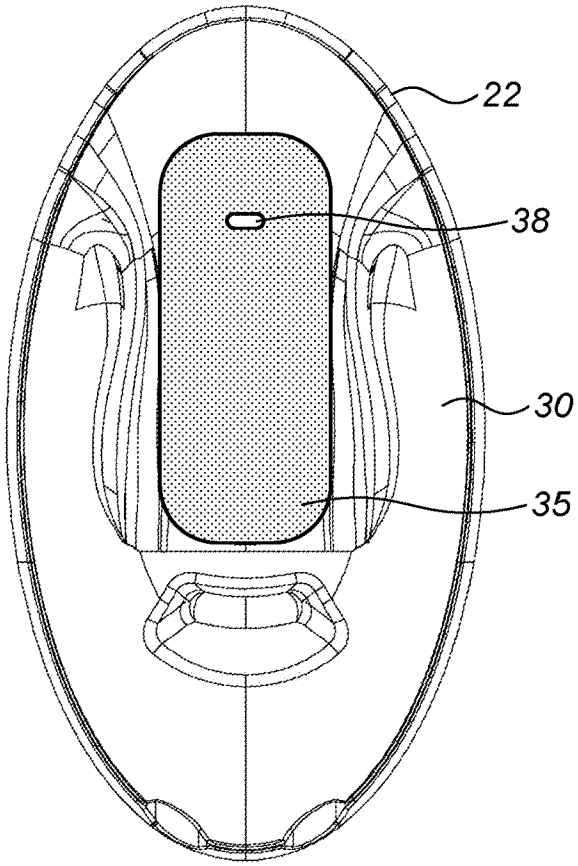
FIGS. 3A-B are schematic illustrations of the outer surface and inner surface, respectively, of a baby bather, in accordance with some embodiments of the present invention.
Figure 3A:
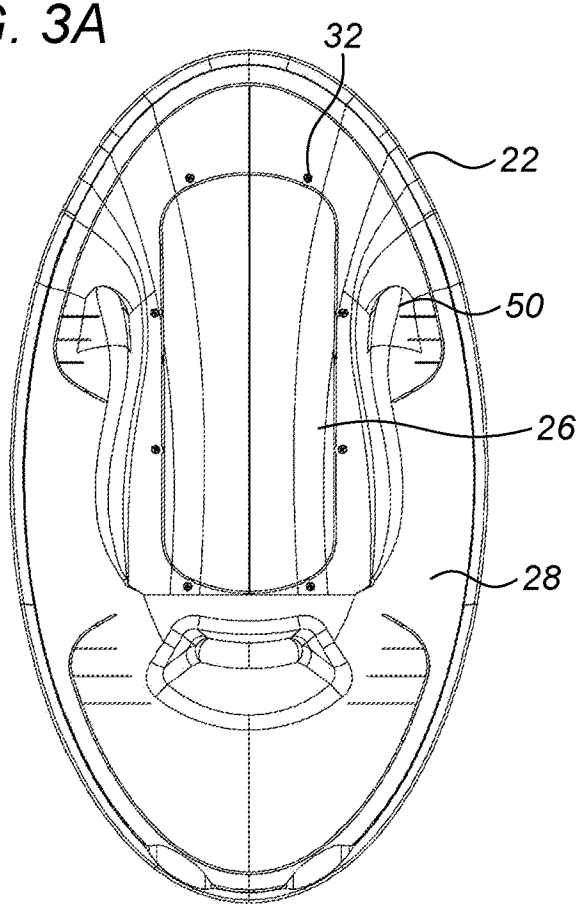
Figure 2:
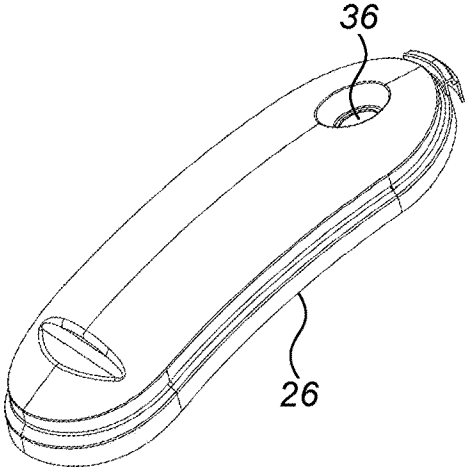
FIG. 2 is a schematic illustration of a container containing a phase-change material (PCM), in accordance with some embodiments of the present invention.

Reference is initially made to FIG. 1, which is a schematic illustration of an apparatus 20, comprising a baby bather 22, for bathing a baby, in accordance with some embodiments of the present invention. Reference is further made to FIG. 2, which is a schematic illustration of a container 26 containing a PCM, in accordance with some embodiments of the present invention. Reference is also made to FIGS. 3A-B, which are schematic illustrations of an outer surface 28 and inner surface 30, respectively, of baby bather 22, in accordance with some embodiments of the present invention.

Apparatus 20 comprises bather 22, container 26, and a heating device 24. Inner surface 30 of the bather comprises a supporting surface 35, configured to support a baby, along with wall surfaces surrounding supporting surface 35. Heating device 24 is reversibly couplable to the bather.

In some embodiments, as shown in FIG. 3A, container 26 generally remains coupled to the bather, e.g., to outer surface 28 of the bather. For example, the container may fit into a cavity in outer surface 28, and a thermally-conducting cover (not shown) may attach to the outer surface over the cavity such that the cover holds the container in the cavity. As a specific example, the outer surface may be shaped to define a plurality of threaded apertures (or "screw holes") 32 surrounding the cavity, and the cover may be attached to the outer surface via respective screws screwed into threaded apertures 32.

In such embodiments, to heat the PCM, the heating device is coupled to the bather, typically such that container 26 is aligned with a heat-transferring surface 34 of the heating device. (The heating device may be coupled to the bather directly, or indirectly, by virtue of being coupled to the container.) Heat is then transferred, via surface 34, into the container. Following the heating of the PCM, the bather may be uncoupled from the heating device, and the bather may then be used; alternatively, the bather may remain coupled to the heating device while the bather is used.

In some embodiments, the bather and heating device are coupled to one another by fitting a portion of the heating device into the bather, or vice versa. For example, the heating device may comprise at least one protrusion configured to fit into a corresponding depression in the bather, or the bather may comprise at least one protrusion configured to fit into a corresponding depression in the heating device. As another example, the container may be held in a recessed portion of the bather whose shape corresponds to that of surface 34, such that the surface fits into the recessed portion. In other embodiments, the bather and heating device are coupled to one another simply by being brought into contact with one another.

FIG. 1 shows an embodiment in which the bather is coupled to the heating device by being placed (or "docked") onto the heating device, such that the bather sits above the heating device. In other embodiments, as further described below with reference to FIG. 3C, the heating device is placed onto the bather.

Typically, the bather and/or heating device comprise structural features and/or visual markers that indicate the proper alignment of the bather with the heating device. For example, for embodiments in which the bather is docked onto the heating device, the bather may comprise legs 50 spaced apart from each other such that when the heating device is between legs 50, surface 34 is aligned with container 26.

In other embodiments, container 26 is reversibly couplable both to the heating device and to the bather (e.g., to outer surface 28). In such embodiments, to heat the PCM, the container is uncoupled from the bather and coupled to the heating device. For example, a portion of the container may fit into the heating device, a portion of the heating device may fit into the container, or the container may simply be placed onto surface 34. Any suitable structural features and/or visual markers may facilitate the proper alignment of the container with surface 34. Subsequently to the heating of the PCM, the container is uncoupled from the heating device and coupled to the bather.

Subsequently to heating the PCM, the bather is used, in that the baby is bathed while the baby lies on supporting surface 35. (Optionally, the bather may be filled with warm water prior to, during, or subsequently to the heating of the PCM.) While the baby is bathed, heat from the PCM is transferred to inner surface 30, thus keeping the baby, along with any water in the bather, warm.

Typically, to facilitate warming the baby, the container is coupled to the underside of the bather, i.e., the portion of outer surface 28 lying behind supporting surface 35. Alternatively or additionally, a PCM container may be coupled to any other suitable portion of outer surface 28, such as a wall of the bather. Alternatively or additionally, a reversibly-couplable or non-reversibly-couplable PCM container may be disposed between the inner and outer surfaces of the bather, e.g., beneath supporting surface 35.

In general, the PCM may comprise a paraffin, a salt hydrate, or any other suitable material. Typically, the heating of the PCM causes the PCM to change from a solid phase to a liquid phase.

In general, the volume of the PCM stored in container 26 varies between embodiments as a function of several factors. These factors include relevant properties, such as the density, heat capacity, and phase-change temperature, of the PCM. For example, when using a PCM having a lower phase-change temperature, a greater volume of the PCM is used, relative to when using another PCM having a higher phase-change temperature. These factors further include the maximum amount of heat that may be safely transferred to inner surface 30, the desired amount of time for which the heat transfer is to occur, and the thermal resistance of the container and of the bather.

Typically, to facilitate transferring heat to the bather, the shape of container 26 conforms to the shape of the portion of the bather to which the container is coupled, such that the surface of the container facing the bather is mostly or entirely in contact with the bather. For example, for embodiments in which the container is coupled to the convex underside of the bather, the surface of the container that faces the bather (i.e., the top surface of the container) may be concave. Similarly, when coupled to other curved portions of the bather, such as a curved wall of the bather, the surface of the container that faces the bather is typically curved.

Similarly, to facilitate heating the PCM, surface 34 is typically shaped to conform to the shape of the container, such that surface 34 is mostly or entirely in contact with the container. For example, for embodiments in which the container is placed onto surface 34 and the bottom surface of the container is convex as in FIG. 3A, surface 34 may be concave, as in FIG. 1.

In some embodiments, container 26 comprises an at least partly transparent portion 36, such as an at least partly transparent window. In such embodiments, while the bather or container is coupled to the heating device, the user may observe, via portion 36, a change in color of the PCM (e.g., a change from white to green) indicating a phase change of the PCM. In response to observing the change in color, the user may begin using the bather. In some such embodiments—particularly those embodiments in which the container remains coupled to the bather—inner surface 30 comprises an at least partly transparent window 38 configured to align with portion 36 while the container is coupled to the bather. Thus, the color of the PCM may be observed via window 38.

(For embodiments in which the container does not comprise portion 36, the container may be heated for a predefined duration known to be sufficient for causing a phase change of at least some of the PCM.)

In some embodiments, the PCM is heated by hot (e.g., boiling) water. In particular, the heating device may be shaped to define a water chamber 27, which is configured to contain water, behind surface 34. By virtue of container 26 being positioned near water chamber 27 while the water is hot, the heating device may heat the PCM.

In some such embodiments, the heating device comprises a heating element 44, comprising a positive temperature coefficient (PTC) ceramic or any other suitable material, configured to heat the water, such that the water may then heat the PCM. (The water may be heated before and/or after the bather or container is coupled to the heating device.) The heating element may be supplied with electricity via a power cord 42 connected to a suitable source of electricity, or by batteries in the heating device. In such embodiments, the heating device typically comprises a thermostat and/or another temperature sensor configured to stop the heating of the water upon the water reaching a predefined maximum temperature, e.g., 100 degrees Celsius. Alternatively, the heating device may comprise a mechanism configured to stop the heating of the water upon the water beginning to boil.

Thus, as illustrated in FIG. 1, the user may pour unheated water 46 into the water chamber through an opening 40 in the heating device. (Optionally, the vessel 47 from which water 46 is poured may be marked to indicate the volume of the water chamber.) Subsequently, the water may be heated by the heating element, such that the water heats the PCM. Subsequently to heating the PCM, the water may be emptied from the water chamber. Alternatively, the water chamber may be prefilled and sealed during the manufacture of the heating device, and the water in the water chamber may be repeatedly heated by the heating element.

In other embodiments, the heating device does not comprise a heating element. Rather, the user heats (e.g., boils) water using a separate device, such as a kettle. Subsequently, the user pours the heated water, through opening 40, into the water chamber. (Similarly, the user may pour heated water into the water chamber even in those embodiments in which the heating device comprises a heating element.)

An advantage of a heating device utilizing hot water, as described hereinabove, is that such a heating device provides an inherent limit to the amount of heat that may be transferred to the PCM, this limit being a function of the volume of the water chamber and the maximum temperature of the water therein, which is typically 100 degrees. During the design of the heating device, the volume of the water chamber may be set such that even if the water chamber is full of water at the maximum temperature, the amount of heat transferred to the PCM remains within a predefined safety limit.

Figure 3C:
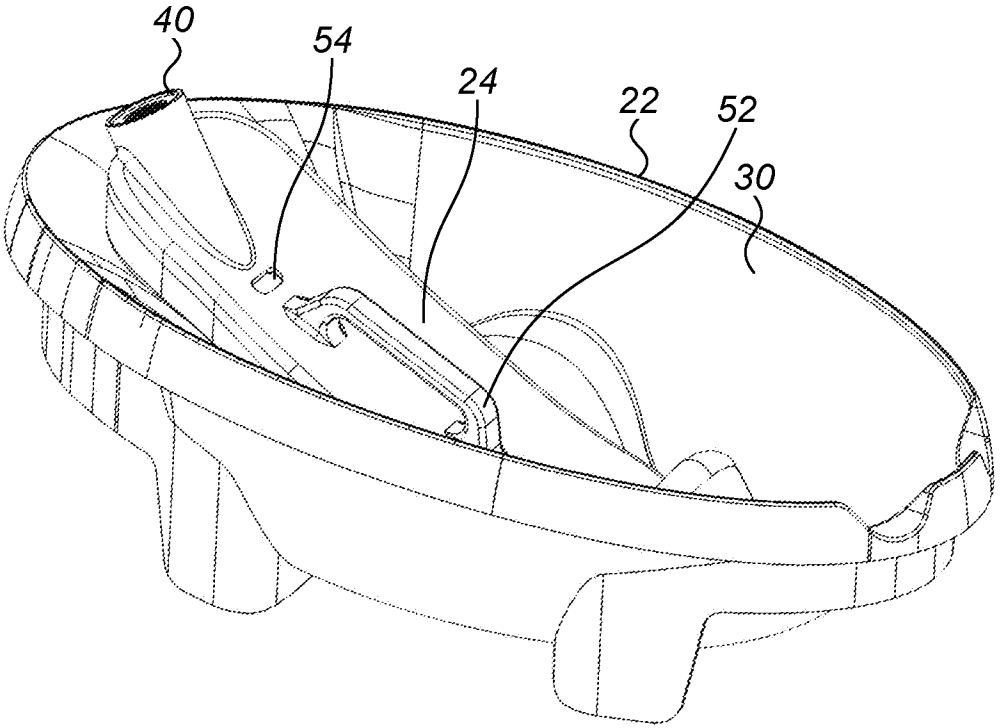
FIG. 3C is a schematic illustration of an alternative coupling of a baby bather to a heating device, in accordance with some embodiments of the present invention.

Reference is now made to FIG. 3C, which is a schematic illustration of an alternative coupling of the baby bather to heating device 24, in accordance with some embodiments of the present invention.

Alternatively to coupling to the outer surface of the bather as in FIG. 1, the heating device may couple to inner surface 30 such that surface 34 (FIG. 1) of the heating device contacts the inner surface. For example, for embodiments in which the PCM container is behind supporting surface 35 (FIG. 1), the heating device may couple to supporting surface 35. In such embodiments, the heating device may comprise a handle 52, and/or an at least partly transparent window 54 configured to align with window 38 (FIG. 3B) when the heating device is coupled to the bather.

Figure 4:
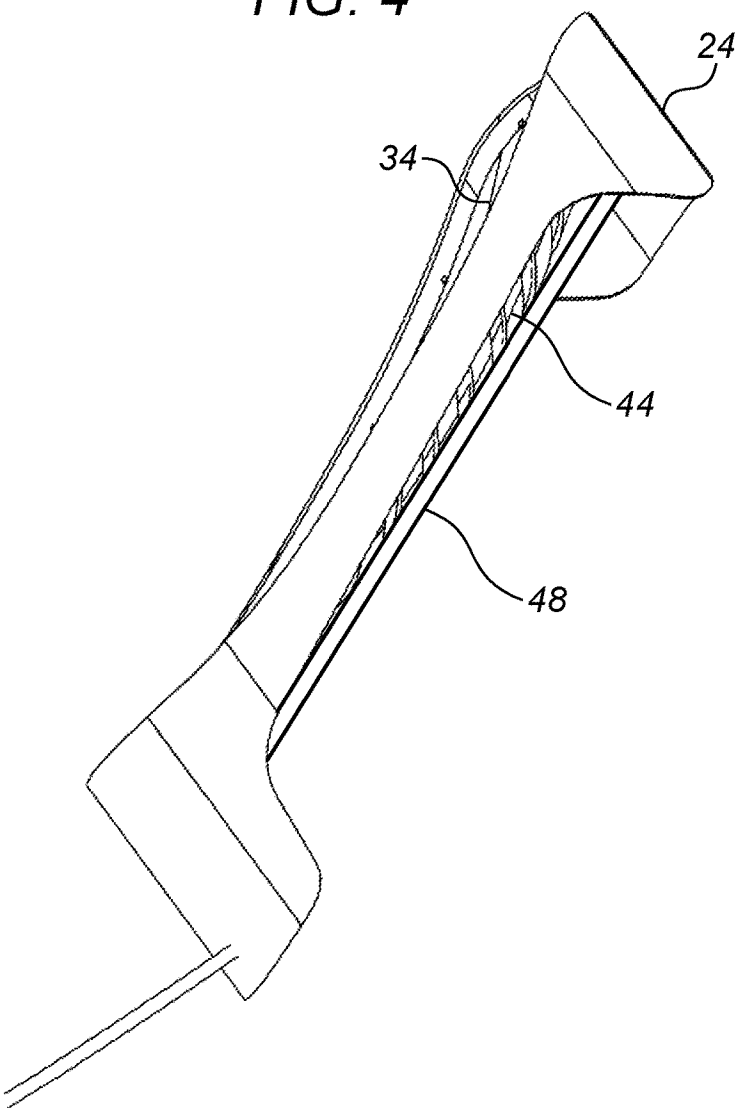
FIG. 4 is a schematic illustration of a heating device, in accordance with some embodiments of the present invention.

Reference is now made to FIG. 4, which is a schematic illustration of heating device 24, in accordance with some embodiments of the present invention.

In some embodiments, the heating device does not comprise a water chamber. Rather, the heating device comprises heating element 44, which is configured to heat the PCM directly (i.e., not by heating another element, such as water, that then heats the PCM). Typically, the heating element is disposed behind surface 34 and is shaped to conform to the shape of surface 34. For example, for embodiments in which surface 34 is concave, the heating element may also be concave. Typically, for safety, a cover 48 covers the heating element. The heating device may be coupled to the inner surface or outer surface of the bather, or to the PCM container separately from the bather, as described above.

In yet other embodiments, the heating device comprises a sack made from rubber and/or another compliant material. Subsequently to filling the sack with hot water, the PCM container, or the entire bather, is placed onto the sack, such that the surface of the sack conforms to the outer surface of the container or bather. Subsequently, the water in the sack heats the PCM.

Figure 5:
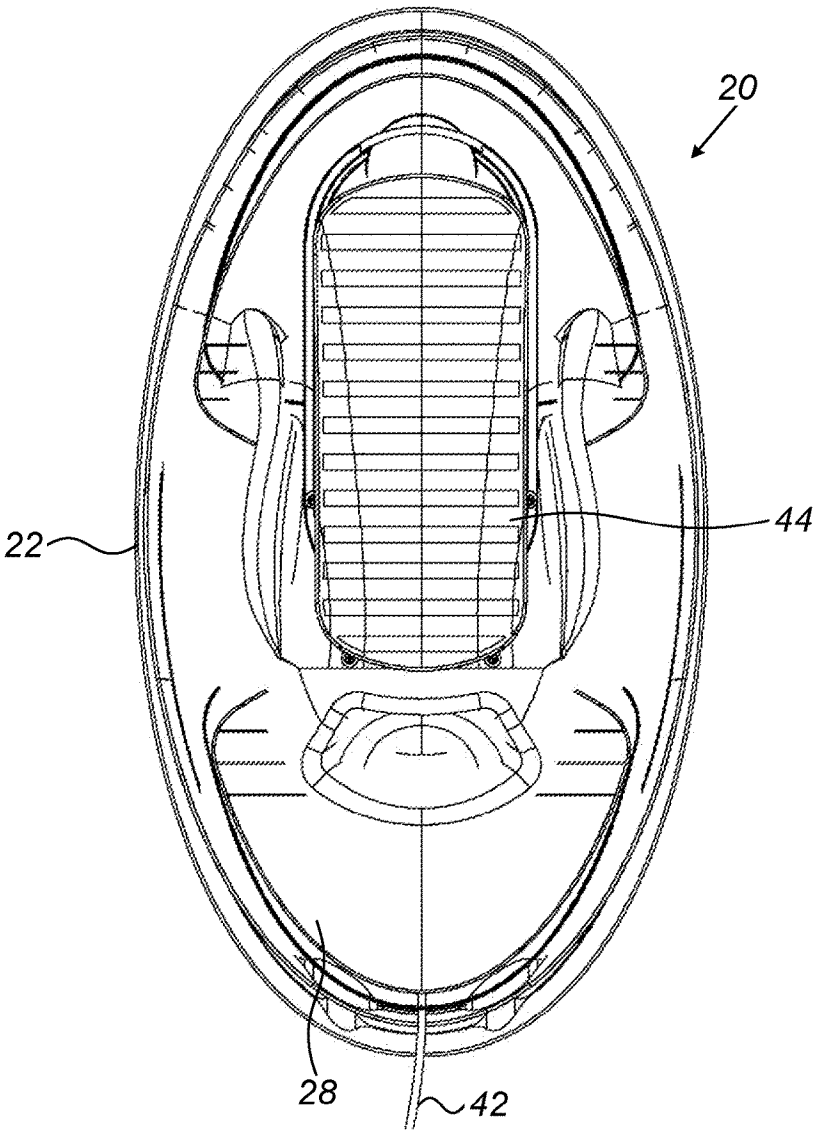
FIG. 5 is a schematic illustration of an apparatus for bathing a baby, in accordance with some embodiments of the present invention.

Reference is now made to FIG. 5, which is a schematic illustration of apparatus 20 in accordance with some embodiments of the present invention.

In some embodiments, apparatus 20 does not comprise heating device 24. Rather, heating element 44 is coupled to the bather together with the PCM container. (Typically, for safety, the heating element is covered, as described above with reference to FIG. 4.) For example, FIG. 5 shows an embodiment in which the heating element is coupled to outer surface 28, with the PCM container disposed between heating element 44 and outer surface 28 (and thus being hidden from view in the figure). The heating element heats the PCM such that, subsequently to the heating of the PCM, heat is transferred from the PCM to the bather.

In some such embodiments, bather 22 comprises cord 42, and electricity is supplied to the heating element via cord 42. In other embodiments, the electricity is supplied by batteries in bather 22.

Figure 6:
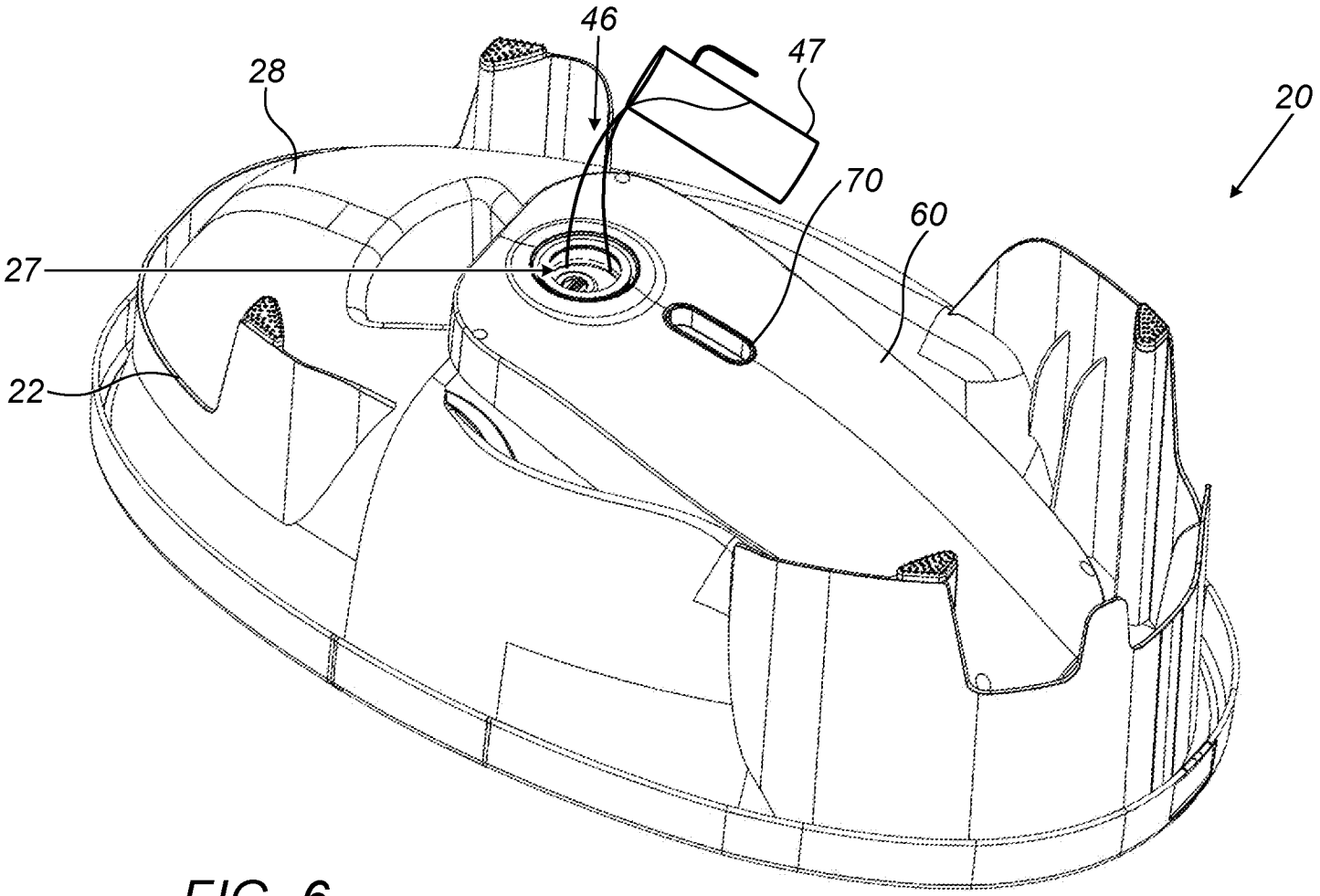
FIG. 6 is a schematic illustration of another apparatus for bathing a baby, in accordance with some embodiments of the present invention.
Figure 7:
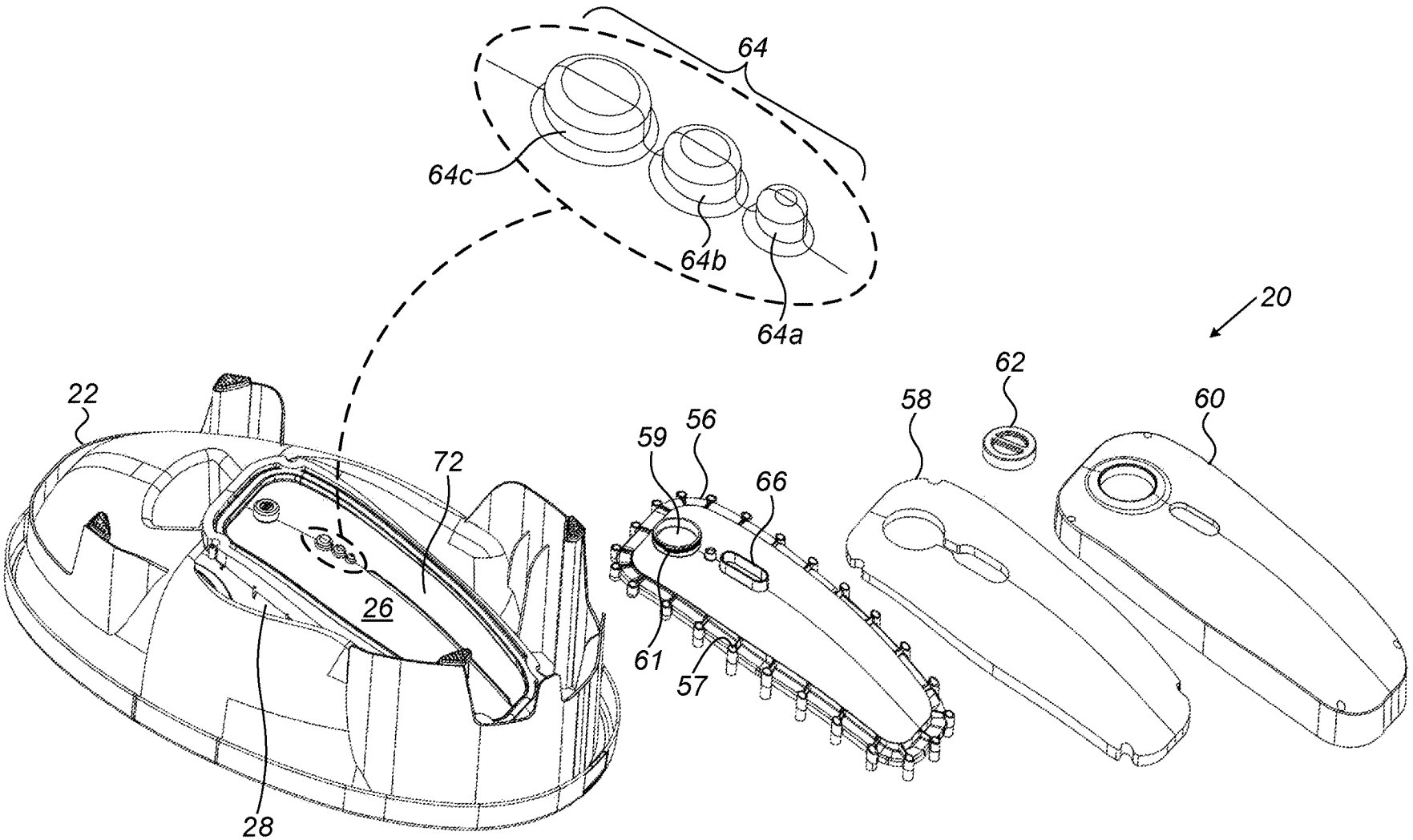
FIG. 7 is a schematic exploded view of the apparatus shown in FIG. 6, in accordance with some embodiments of the present invention.

Reference is now made to FIG. 6, which is a schematic illustration of apparatus 20, in accordance with other embodiments of the present invention. Reference is further made to FIG. 7, which is a schematic exploded view of the apparatus shown in FIG. 6, in accordance with some embodiments of the present invention. (FIGS. 6-7 show the bather in an upside-down position.)

In FIGS. 6-7, similarly to FIG. 5, apparatus 20 does not comprise a separate heating device. FIGS. 6-7 differ from FIG. 5, however, in that water chamber 27 is an integrated part of bather 22, and the PCM is heated by water 46 in the water chamber.

Specifically, as shown in FIG. 7, container 26 is coupled to the bather, e.g., to outer surface 28 behind supporting surface (FIG. 1). A cover 56, which is coupled to outer surface 28 (e.g., via a plurality of screws inserted through apertures 57 in cover 56), is configured to contain water 46 between cover 56 and the container. In other words, water chamber 27 includes the volume between cover 56 and container 26. (In some embodiments, the cover is coupled to the bather by virtue of being coupled to the container, which is coupled to the bather. In yet other embodiments, cover 56 belongs to a separate water container coupled to outer surface 28, such that the cover is coupled to the outer surface by virtue of the water container being coupled to the outer surface.)

Typically, cover 56 is shaped to define an opening 59, and a cap 62 is configured to reversibly cover opening 59. For example, opening 59 may be surrounded by a threaded rim 61, and cap 62 may screw onto threaded rim 61. Thus, to heat the PCM, the user may remove cap 62, and then fill the water chamber with heated water. (Optionally, vessel 47 may be marked to indicate the volume of the water chamber, as described above with reference to FIG. 1.) Subsequently, the user may replace cap 62, such that the water chamber is closed while the PCM is heated; alternatively, the water chamber may remain open. In either case, the water chamber may be emptied subsequently to the heating of the PCM, either before or after the bather is used.

Alternatively, cap 62 may be omitted, such that the user is forced to empty the water chamber prior to using the bather. In such embodiments, a larger volume of water may be used for heating the PCM, thus facilitating a faster heating of the PCM without risking the transfer, from the water, of excess heat to the bather while the bather is used. (Optionally, opening 59 may have a non-standard shape, so as to inhibit the closing of the opening by any other cap.)

In some embodiments, cover 56 is covered by yet another cover 60, with an insulating foam pad 58 disposed between the two covers. Advantageously, pad 58 may inhibit heat from escaping into the surrounding air, such that almost all the heat from the water is transferred to the PCM. Cover 60 and pad 58 may be shaped to define respective openings that align with opening 59, such that cover 60 and pad 58 do not impede the removal and replacement of cap 62.

In some embodiments, apparatus 20 further comprises heating element 44 (FIG. 5). For example, cover 56, or a separate heating device, may comprise the heating element. In such embodiments, electric power supplied to the heating element via a power cord or by batteries may heat the water, as described above with reference to FIG. 5. Thus, the user may pour unheated water into the water chamber. Alternatively, the water chamber may be prefilled during the manufacture of the bather, and the water in the water chamber may be repeatedly heated; in such embodiments, opening 59 and cap 62 may be replaced by a permanent seal.

In some embodiments, container 26 comprises an at least partly transparent portion 72; for example, the entire bottom surface of container 26 (which faces upward in FIGS. 6-7) may be at least partly transparent, or container 26 may comprise an at least partly transparent window. In such embodiments, cover 56 comprises an at least partly transparent window 66 aligned with portion 72 of the container, such that the color of the PCM may be observed via window 66. So as not to impede this observation, pad 58 and cover 60 may be shaped to define respective windows 70 that align with window 66. (Each of the aforementioned windows may include a plastic or glass pane, or the window may be open, without a pane.)

Optionally, portion 72 may be shaped to define a plurality of differently-sized protrusions 64 filled with the PCM. (Typically, protrusions 64 are in fluid communication with the remaining volume of the container.) By virtue of their different respective sizes, protrusions 64 have different respective surface-area-to-volume ratios, such that the color change is observed in the protrusions at different respective times. The number of protrusions in which the color of the PCM has changed thus indicates, to the user, the remaining time required for sufficient heating of the PCM. For example, a color change in the largest protrusion indicates that the PCM has been heated sufficiently for use of the bather (even if not all the PCM has changed phase).

For example, as shown in FIG. 7, portion 72 may be shaped to define three protrusions 64. The PCM contained in the smallest protrusion 64*a* (which has the largest surface-area-to-volume ratio) may change color first, e.g., after 30-60 seconds. Next, a larger protrusion 64*b* may change color. Finally, the largest protrusion 64*c* may change color, e.g., after 4-6 minutes.

In some embodiments, apparatus 20 does not comprise a PCM; rather, hot water in water chamber 27 transfers heat directly to the bather.

Other Embodiments

In other embodiments, to heat the PCM, container 26 is uncoupled from the bather and placed in a microwave oven for a predefined period of time. Subsequently, the container is recoupled to the bather. In such embodiments, container 26 may contain some water so as to facilitate the heating of the PCM.

It is noted that the scope of the present invention includes embodiments in which the PCM is disposed behind inner surface 30 (FIG. 1) even without being contained in a separate container. For example, the PCM may be contained between inner surface 30 and outer surface 28 (FIG. 3A). In other words, the bather may comprise a compartment between the inner and outer surfaces thereof, and the compartment may be filled with the PCM. In such embodiments, a portion of outer surface 28 may be transparent, such that changes in the color of the PCM may be observed via the transparent portion of the outer surface.

Alternatively or additionally to a PCM, any other suitable heat-transfer material that, by virtue of its heat capacity and thermal conductivity, absorbs heat and then transfers the heat over an extended period of time, may be used as described above for the PCM. Examples of such heat-transfer materials include water, copper, silica gel, and buckwheat. In some embodiments, an additional material that changes color upon heating, such as a thermochromatic powder or dye, is mixed with the heat-transfer material. By observing changes in the color of the additional material as described above for the PCM, the user may ascertain when the heat-transfer material has been sufficiently heated.

Alternatively or additionally to observing a change in color, the user may use any other suitable technique to ascertain that the heat-transfer material (e.g., the PCM) has been sufficiently heated. For example, the user may touch the container in which the heat-transfer material is contained, a surface of the bather behind which the heat-transfer material is disposed, or a heat-transferring element that contacts the heat-transfer material and protrudes from the container or the bather. Alternatively, the apparatus may comprise a temperature sensor configured to display a suitable output to the user when the heat-transfer material has been sufficiently heated.

It is noted that embodiments described herein may be combined with an integrated bathing weighing unit, e.g., as described in co-assigned U.S. Pat. No. 7,999,198, which is incorporated herein by reference.

Although the present description relates mainly to a baby bather, it is noted that a heat-transfer material may be used, as described herein, with any suitable person-supporting structure, such as a full-size bathtub, a changing table, or a seat, such as a baby bath-seat. In such alternate embodiments, any first surface of the person-supporting structure that faces the person while the person is supported by the person-supporting structure—such as the floor or inner wall of a bathtub, or the top surface of a changing table or seat—is analogous to inner surface 30 (FIG. 1), while any second surface behind the person-facing surface (and typically facing away from the person)—such as the outer wall of a bathtub or the bottom surface of a changing table or seat—is analogous to outer surface 28 (FIG. 3A). As described herein, a heat-transfer material may be disposed behind the first surface, e.g., in a container coupled to the second surface or in a compartment between the first and second surfaces. The heat-transfer material may be heated by a separate heating device, by water surrounding the heat-transfer material, or by a heating element coupled to the person-supporting structure. For larger structures requiring a greater input of energy, such as a full-size bathtub, multiple containers of heat-transfer material may be used.

Moreover, the heating devices described herein may be used to heat a heat-transfer material or any other material, even without any subsequent transfer of heat to a person-supporting structure. Thus, for example, wax for application to skin of a subject (e.g., for hair removal) may be heated by any of the heating devices described herein. Advantageously, as described above with reference to FIG. 1, a hot-water-based heating device may be particularly effective at safely limiting the amount of heat transferred to the wax.

It will be appreciated by persons skilled in the art that the present invention is not limited to what has been particularly shown and described hereinabove. Rather, the scope of embodiments of the present invention includes both combinations and subcombinations of the various features described hereinabove, as well as variations and modifications thereof that are not in the prior art, which would occur to persons skilled in the art upon reading the foregoing description. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. Apparatus, comprising:

a person-supporting structure comprising a first surface, configured to face a person while the person-supporting structure supports the person, and a second surface behind the first surface;

a heat-transfer material;

a container containing the heat-transfer material and coupled to the second surface of the person-supporting structure; and a cover coupled to the second surface of the person-supporting structure and configured to contain water between the cover and the container such that the water transfers heat to the person-supporting structure via the heat-transfer material.

2. The apparatus according to claim 1, wherein the heat-transfer material comprises a phase-change material (PCM).

3. The apparatus according to claim 1, wherein the cover is coupled to the second surface of the person-supporting structure by virtue of being coupled to the container.

4. The apparatus according to claim 1, wherein a surface of the container is curved.

5. The apparatus according to claim 1, wherein the cover comprises a heating element configured to heat the water such that the water transfers the heat to the person-supporting structure.

6. The apparatus according to claim 1, wherein the container comprises an at least partly transparent portion, and wherein the cover comprises an at least partly transparent window aligned with the at least partly transparent portion of the container.

7. The apparatus according to claim 6, wherein the at least partly transparent portion is shaped to define a plurality of differently-sized protrusions filled with the heat-transfer material.

8. The apparatus according to claim 1, wherein the person-supporting structure comprises a bathtub.

9. The apparatus according to claim 8, wherein the bathtub comprises a baby bather.

10. A method, comprising:

transferring heat, via a heat-transfer material, to a person-supporting structure including a first surface, configured to face a person while the person-supporting structure supports the person, and a second surface behind the first surface, from water contained between (i) a cover coupled to the second surface of the person-supporting structure, and (ii) a container containing the heat-transfer material and coupled to the second surface of the person-supporting structure; and using the person-supporting structure while the heat is transferred, via the heat-transfer material, to the person-supporting structure.

* * * * *